US005452847A

United States Patent [19]

Harris et al.

[11] Patent Number: 5,452,847

[45] Date of Patent: Sep. 26, 1995

[54] STACKABLE CONTAINER WITH RECESSED HINGED LID AND HINGE MEANS THEREFOR

[75] Inventors: Stephen Harris, Pasadena, Md.; James K. Baker, Ypsilanti, Mich.; Eugene Dow, Royal Palm Beach, Fla.

[73] Assignee: United States Corrulite Corporation, Clewiston, Fla.

[21] Appl. No.: 361,948

[22] Filed: Dec. 22, 1994

[51] Int. Cl.[6] ..... A65D 43/16

[52] U.S. Cl. ..... 229/125.11; 16/373; 16/386; 220/334

[58] Field of Search ..... 229/125.11, 199; 220/334; 16/373, 383, 386, DIG. 13

[56] References Cited

U.S. PATENT DOCUMENTS

| | | | |
|---|---|---|---|
| 1,158,132 | 10/1915 | Jacovatos | 229/125.11 |
| 1,645,429 | 10/1927 | Kenyon | 229/125.11 |
| 2,137,529 | 11/1938 | Ferris | 16/386 |
| 2,939,604 | 6/1960 | Falk | 220/334 |
| 3,520,246 | 7/1970 | Hester | 220/334 |
| 3,931,663 | 1/1976 | Holmes et al. | 16/DIG. 13 |
| 4,884,317 | 12/1989 | Lin | 16/DIG. 13 |
| 5,051,725 | 9/1991 | Caccitolo | 220/334 |
| 5,152,596 | 10/1992 | Raleigh | 16/373 |
| 5,328,048 | 7/1994 | Stein | 220/334 |
| 5,355,559 | 10/1994 | Bowers et al. | 16/386 |

*Primary Examiner*—Gary E. Elkins
*Attorney, Agent, or Firm*—Perman & Green

[57] ABSTRACT

A rectangular stackable container, such as a tote box, having a lid or cover which is hingedly-attached at the upper rim area along one or both sides of the bin portion of the container. The rim area of the bin portion contains a rim-reinforcing wire, portions of which are exposed and releasably engaged by novel hinge means which are fastened to the lid and support the lid recessed slightly below the level of the rim when the lid is in closed position. The hinge means preferably are extruded from polyvinyl chloride.

9 Claims, 2 Drawing Sheets

STACKABLE CONTAINER WITH RECESSED HINGED LID AND HINGE MEANS THEREFOR

BACKGROUND OF THE INVENTION

1. Field of the Invention

The present invention relates to containers and hinges therefor, such as tote boxes, which are constructed of durable material, such as corrugated plastic board, and which have a hinged cover means to shield and protect the contents. Such containers are intended for reuse and are designed to be stackable for storage and/or shipment purposes.

2. State of the Art

Reference is made to U.S. Pat. Nos. 2,947,462; 3,685,719 and 4,046,312 for their disclosures of cartons or boxes having cover means, wire reinforcing rims, partition inserts and other features common in the art.

Among the problems encountered with covered, stackable containers are the need to remove the covers from the containers in order to gain access to the interior, which can result in loss of the cover and/or failure to replace it over the container. Another problem arises from the fact that the cover for the container generally forms a flat upper surface of the container, either as hinged flap extensions of the container side panels and end panels, or as a removable lid which overlaps the side panels and end panels of the container. Thus stacked containers of such construction can slide relative to one another, such as during shipment, and the position of each container is not fixed relative to the container on which it is stacked, which can result in damage to the rim areas of the latter.

SUMMARY OF THE INVENTION

The present invention relates to novel nestable, stackable containers of durable construction, having lid means which are detachably supported by a reinforcing metal wire at the rim area of the container, and to novel snap-on hinge means. The hinge means are configured to support the lid between open position, in which each lid is pivoted about the rim-reinforcing wire on which it is supported to a position parallel to a wall panel of the container, and closed position, in which each lid is pivoted about the rim-reinforcing wire to a position perpendicular to said wall panel and parallel to the floor of the container, and is recessed within the container a sufficient distance to provide a recessed seat to receive and retain the base of a similar nestable, stackable container thereon.

The hinge means are extruded or molded from durable synthetic resinous composition and have an open wire-receiving pivot recess or bearing member having an entrance which is sufficiently flexible or pliable to permit the supporting wire to be forced into the pivot recess and to be forcibly removable therefrom, and to pivotably retain the wire therein in the absence of removal force.

THE DRAWINGS

Figure 3:
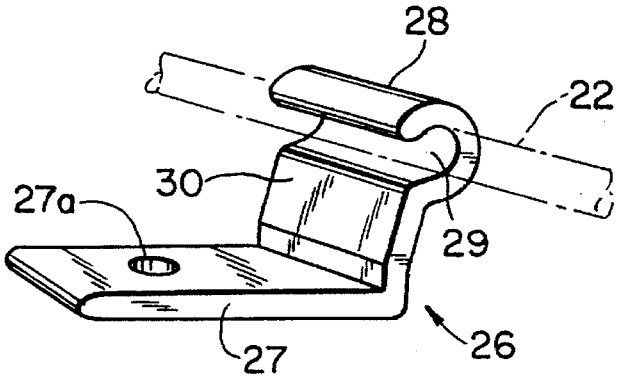
Figure 2:
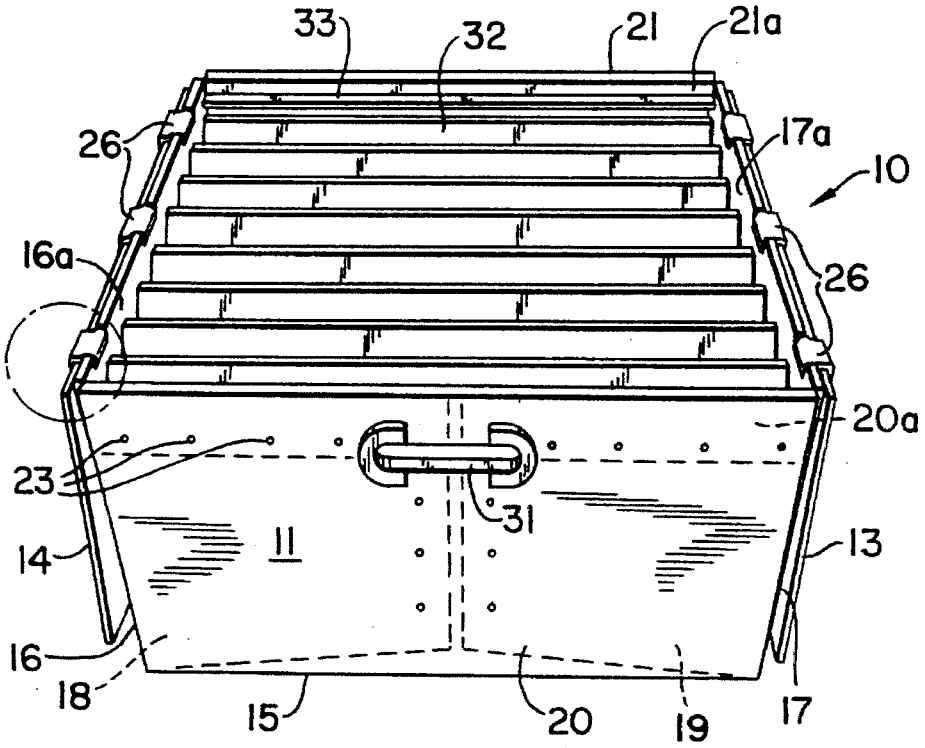
FIG. 2 is a perspective illustration of the container of FIG. 1 but having the opposed half-lids both shown in open position.
Figure 2A:
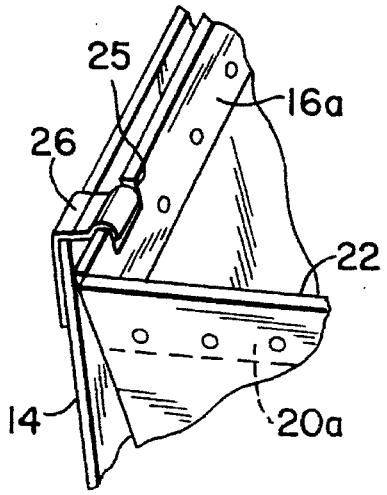

FIG. 2*a* is a view of a corner section of the container of FIG. 2, with flap 16*a* cut away to illustrate the position of the rim-reinforcing wire and its engagement with the hinge; and FIG. 3 is a perspective view of an extruded plastic snap-on hinge as used on the present containers.

DETAILED DESCRIPTION

The novel hinged containers 10 of the present invention comprise a rectangular tub or bin element 11 and a flat lid element 12 which preferably consists of opposed half-lids 13 and 14 as illustrated.

The bin element 11 may be of substantially the same construction as conventional tote boxes having wire reinforcing rims, and reference is made to U.S. Pat. No. 4,046,312 for its disclosure of nestable tubs or bins having wire reinforcing rims and suitable for modification and use as the bin elements 11 of the present containers 10.

The present bin elements 11 preferably are constructed of strong, relatively lightweight corrugated plastic board and generally are formed from a single sheet thereof, cut as a blank of predetermined dimensions and folded to form the rectangular base panel 15, opposed side panels 16 and 17, each having side extension flaps 18 and 19, and opposed end panels 20 and 21. Each of the panels 16, 17, 20 and 21 is tapered upwardly and outwardly and formed to have a narrow upper extension flap, 16*a*, 17*a*, 20*a* and 21*a* respectively, which is folded inwardly and downwardly over a rim-reinforcing rounded metal wire 22 and secured to the panel from which it extends, such as by means of welds, staples or plastic fasteners 23, as illustrated. The wire 22, such as of steel, has a diameter between about 1/16" and 1/4", preferably about 3/16".

The rim areas of the opposed side panels 16 and 17, along the fold lines of the extension flaps 16*a* and 17*a*, are provided with one or more cut-outs or windows 25 so that the reinforcing wire 22 is exposed and accessible in these areas for snap-on engagement with a hinge element 26, as illustrated in FIG. 3, to allow the necessary hinge movement between open and closed positions.

The hinge elements 26 as illustrated by FIG. 3 comprise a unitary pliable plastic body having a lower, flat, lid-attachment finger or horizontal flange 27, a slightly flexible or pliable upper wire-engagement bearing member 28 having a cylindrical passage having a diameter similar or slightly larger than the diameter of the wire 22, and having an entrance slot 29 which is slightly smaller than the diameter of wire 22, but which is pressure-extendable to receive the wire due to the slight flexibility or pliability of the bearing member 28. The hinge 26 also has a downwardly and outwardly depending wall 30 connecting the flange 27 and the member 28 in vertically-offset relation.

A hinge element 26 is snapped onto the rim-reinforcing wire 22 exposed at each of the windows 25 at the tops of the opposed side panels 16 and 17 so that the lid-attachment flanges or fingers 27 extend horizontally into the bin 11. The half-lids 13 and 14 are secured to the hinge elements 26 at the tops of the side panels 16 and 17 by passing a plastic fastener 30 through holes in the lids 13 and 14 and through an aligned hole 27*a* in each hinge flange 27 and engaging it with the fastener retainer so that each half lid 13 and 14 is hingedly attached to the reinforcing wire 22 for pivotal movement between recessed horizontal closed position, shown in FIG. 1, and depending vertical open position in which they are supported outwardly of walls 17 and 16, respectively.

Figure 1:
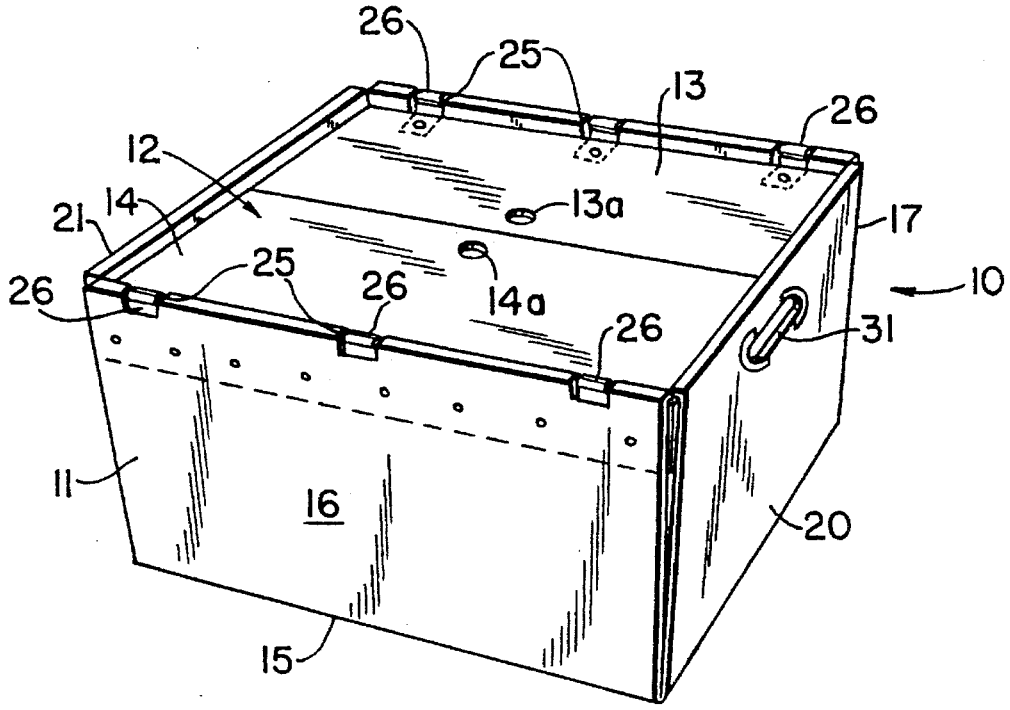
FIG. 1 is a perspective illustration of a container according to the present invention, having opposed half-lids, both shown pivoted to closed position.

In the embodiment illustrated by FIGS. 1, 2 and 2A, the hingedly-attached lid comprises half-lids 13 and 14 which are dimensioned to be suspended neatly in open position, adjacent the side panels 17 and 16 at the rim areas of which they are attached, and to provide a recessed cover for the bin 11 when pivoted to closed position. Preferably the lids 13 and 14 are provided with finger holes 13*a* and 14*a* to facilitate opening thereof, and the bin element 11 is provided with opposed handle means 31 in the opposed end panels 20 and 21, as illustrated.

The present containers 10, according to a preferred embodiment, include a recessed durable insert member 32 which functions as a divider or partition means and also as a stop member or support member for the half-lids 13 and 14 in horizontal closed position, to support the weight of a similar container 10 nested thereon. The base panel 15 of each container 10 is smaller in length and width than the recessed area of the container within the wire-reinforced rim, so that one container placed upon another is nested within the recessed area and is restrained against relative movement and dislodgement. The upper edges of the vertical elements of the insert member 32, such as interlocked sheets of corrugated plastic board, are coplanar with the undersurfaces of the lids 13 and 14 in closed positions, to provide weight-supporting strength. Alternatively, the end walls 20 and 21 of the bin element 11 may be provided with stop members 33, shown in FIG. 2, which are recessed below the rims of panels 20 and 21 and provide shoulders which extend inwardly to engage and support the closed lids 13 and 14 in the presence or absence of an insert member 32.

It will be apparent to those skilled in the art that an essential feature of the present containers is the design of the hinges 26 wherein the upper bearing portion 28 is supported above the plane of the lid-attachment flange or finger 27 and is connected thereto by a downwardly and outwardly tapered wall 30. Thus, the lids 13 and 14 are supported recessed below the rim of the container, when in closed position, with the hinge-attached edges thereof supported spaced from the inside surfaces of side panel flaps 16*a* and 17*a* by the tapered walls 30 of the hinges 26.

For economy purposes, the present hinges 26, shown most clearly in FIG. 3, are extruded as continuous elongate strips from suitable synthetic resinous extrusion composition which produces a strong yet somewhat pliable or flexible extrusion. Thereafter the elongate extrusion is cut into hinge segments of the desired widths, such as about one inch, as illustrated in the present drawings, or greater widths to provide hinges which are used in smaller numbers, including the use of a single hinge corresponding closely to the width of the entire lid.

Suitable non-brittle high tensile strength synthetic resinous compositions will be apparent to those skilled in the plastic extrusion art and include polyvinyl chloride (PVC), synthetic rubbers such as acrylonitrile-butadiene-styrene (ABS), polycarbonates, nylon polyamides and similar polymers.

While the drawings illustrate the use of three spaced narrow hinges 26 supporting each of the lids 13 and 14, it will be apparent to those skilled in the art that a larger or smaller number of narrower or wider hinges 26 can be used, including the use of a single wide hinge at each side supporting half-lids 13 and 14 or at only one side supporting a single recessed lid of sufficient length to cover the entire bin 11.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A stackable, nestable container comprising a bin element having a floor and peripheral opposed side walls and opposed end walls, said walls having an upper peripheral rim containing a rim-reinforcing rounded metal wire, a flat lid portion hingedly-attached to said metal wire along at least one side wall for pivotal movement between open position in which it is supported outwardly of said bin element, and closed position in which it is supported parallel to the floor of the bin element to cover the container, and hinge means comprising a slightly flexible or pliable upper bearing portion having an opening which is more narrow than the diameter of said rounded metal wire but is pressure-extendable to admit said rounded metal wire for frictional engagement within the bearing portion, a lower flange or finger portion attached adjacent an edge of said flat lid portion, and a downwardly and outwardly-extending wall between said bearing portion and said finger portion for supporting the lid portion in closed position on a horizontal plane below the upper peripheral rim and vertically offset inwardly of the upper peripheral rim, whereby the flat lid portion in closed position is recessed below the level of the peripheral rim to provide a stackable, nestable container.

2. A container according to claim 1 constructed of corrugated plastic board.

3. A container according to claim 1 further comprising a stop member for. engaging and supporting the flat lid portion in closed position.

4. A container according to claim 3 in which the stop member comprises an insert member having vertical partition walls, at least portions of the upper edges of which engage the undersurface of the flat lid portion in closed position.

5. A container according to claim 1 in which said flat lid portion comprises a pair of half-lids, an edge of each of which is attached to one or more hinges attached to said metal wire along a side wall of said container.

6. A container according to claim 1 in which each said hinge means comprises an extrusion of synthetic plastic composition.

7. A container according to claim 6 in which said synthetic plastic composition comprises polyvinyl chloride.

8. A unitary hinge member, for releasable friction rotation engagement with a supporting rounded pivot member, said hinge member being formed from synthetic thermoplastic composition, comprising an upper bearing portion, a downwardly and outwardly tapered wall and a lower horizontal extension of said tapered wall for attachment to a lid, said bearing portion having a cylindrical axial passage having a diameter slightly larger than the diameter of a rounded pivot member to be engaged therewithin, and having an elongate opening for admitting the pivot member to said passage, said opening being slightly smaller in width than the diameter of said rounded pivot member and said bearing portion being slightly flexible or pliable to permit the pivot member to be forcibly introduced and removed from said passage, said tapered wall supporting said lower horizontal extension thereof vertically and horizontally offset relative to said bearing portion.

9. A hinge member according to claim 8 which is extruded from polyvinyl chloride as the synthetic thermoplastic composition.

* * * * *